US010240444B2

(12) United States Patent
Gumarov et al.

(10) Patent No.: US 10,240,444 B2
(45) Date of Patent: Mar. 26, 2019

(54) MODELING AND ANALYSIS OF HYDRAULIC FRACTURE PROPAGATION TO SURFACE FROM A CASING SHOE

(71) Applicant: M-I L.L.C., Houston, TX (US)

(72) Inventors: Salamat Gumarov, Atyrau (KZ); Talgat A. Shokanov, Almaty (KZ); Julio Roberto Ronderos, Houston, TX (US); Kevin Simpson, Perth (AU); Viacheslav Viktorovich Anokhin, Houston, TX (US); Said Benelkadi, Aberdeen (GB)

(73) Assignee: M-I L.L.C., Houston, TX (US)

( * ) Notice: Subject to any disclaimer, the term of this patent is extended or adjusted under 35 U.S.C. 154(b) by 748 days.

(21) Appl. No.: 14/376,809

(22) PCT Filed: Feb. 6, 2013

(86) PCT No.: PCT/US2013/024959

§ 371 (c)(1),
(2) Date: Aug. 5, 2014

(87) PCT Pub. No.: WO2013/119685

PCT Pub. Date: Aug. 15, 2013

(65) Prior Publication Data

US 2015/0041120 A1 Feb. 12, 2015

Related U.S. Application Data

(60) Provisional application No. 61/595,478, filed on Feb. 6, 2012.

(51) Int. Cl.
*E21B 43/26* (2006.01)
*E21B 47/10* (2012.01)

(52) U.S. Cl.
CPC ..... *E21B 43/26* (2013.01); *E21B 47/10* (2013.01)

(58) Field of Classification Search
CPC ..... E21B 43/26; E21B 47/10
(Continued)

(56) References Cited

U.S. PATENT DOCUMENTS 3,165,569 A 1/1965 Bright
5,250,250 A 10/1993 Gorski
(Continued)

FOREIGN PATENT DOCUMENTS

CN 101899972 A 12/2010
CN 102041995 A 5/2011
(Continued)

OTHER PUBLICATIONS

International Search Report and Written Opinion of PCT Application Serial No. PCT/US2013/024959 dated May 15, 2013 (13 pages).
(Continued)

*Primary Examiner* — Eunhee Kim
(74) *Attorney, Agent, or Firm* — Paula B. Whitten

(57) ABSTRACT

A method of designing a well control operation includes obtaining sub-surface data related to a formation surrounding a well, building a geomechanical model of the formation based on the sub-surface data, obtaining operational data related to the well control operation, performing, on a processor, a hydraulic fracture simulation of the formation, wherein the simulation is based on the operational data and the geomechanical model, and determining an estimated volume of fluid required for a fracture to breach an upper surface of the formation.

20 Claims, 20 Drawing Sheets

(58) Field of Classification Search
USPC ..... 703/10; 702/6
See application file for complete search history.

(56) References Cited

U.S. PATENT DOCUMENTS

| | | | | |
|---|---|---|---|---|
| 6,876,959 | B1 | 4/2005 | Peirce et al. | |
| 7,248,969 | B2 | 7/2007 | Patzek et al. | |
| 2004/0040717 | A1* | 3/2004 | Hill | E21B 43/26 166/308.1 |
| 2007/0272407 | A1 | 11/2007 | Lehman et al. | |
| 2009/0169404 | A1 | 7/2009 | Sindt et al. | |
| 2010/0250216 | A1 | 9/2010 | Narr et al. | |
| 2011/0125471 | A1 | 5/2011 | Craig et al. | |
| 2011/0246154 | A1* | 10/2011 | Koutsabeloulis | G01V 99/005 703/6 |
| 2011/0257944 | A1 | 10/2011 | Du et al. | |
| 2012/0143579 | A1* | 6/2012 | Collins | E21B 43/16 703/10 |
| 2013/0032350 | A1* | 2/2013 | Potapenko | E21B 43/26 166/308.1 |

FOREIGN PATENT DOCUMENTS

| | | |
|---|---|---|
| WO | 2011064544 A2 | 6/2011 |
| WO | 2012003027 | 1/2012 |

OTHER PUBLICATIONS

Office Action issued in Chinese Patent Application No. 201380016544.0 dated Jun. 15, 2016; 21 pages (with English translation).
Extended Search Report issued in European Patent Application No. 13747207.2 dated Dec. 10, 2015; 7 pages.
Chavez et al., "Fracture Propagation Prediction in an Openhole Horizontal Injector Well: An Applied Geomechanic Study", SPE 88608, SPE Asia Pacific Oil and Gas Conference and Exhibition, Oct. 18-20, 2004, 11 pages.
Examination Report issued in European Patent Application No. 13747207.2 dated Aug. 17, 2016; 5 pages.
Office Action for the equivalent Eurasian patent application 201491485/27 dated Aug. 11, 2017.
Communication pursuant to Article 94(3) for the equivalent European patent application 13747207.2 dated Jan. 27, 2017.
Examination Report for the equivalent Australian patent application 2016238868 dated May 23, 2017.

* cited by examiner

| Case | Lithology | Leakoff (ft/sqrt min) | Young's modulus (psi) | Frac Toughness (psi) | Poisson's Ratio |
|---|---|---|---|---|---|
| 1 | Siltstone 1 | 0.00032 | 1,000,000 | 1000 | 0.4 |
| 2 | Siltstone 2 | 0.00032 | 500,000 | 1000 | 0.4 |
| 3 | Silty Claystone 1 | 0.00008 | 500,000 | 1000 | 0.4 |
| 4 | Mudstone 1 | 0.00008 | 1,000,000 | 3000 | 0.4 |
| 5 | Silty Claystone 2 | 0.00008 | 250,000 at Top Linearly increasing to 750,000 at Bottom (20" shoe) and further below | 1000 | 0.4 |

*FIG. 7A*

Mud
-MW =1.46 SG (12.16 ppg)
-PV = 50
-YP = 30
-Power Law Model
-n' = 0.7
-K' = 0.0106179
-Viscosity @ 170 s^-1 = 111.0 co Pump Rate
42 bpm

*FIG. 7B*

| TVDRT, m | | TVDBML, m | | Formation | Lithology | Pore Pressure Gradient | Pore Pressure | Fracture Gradient | Minimum Horizontal Stress | Young's Modulus | Fracture Toughness | Poisson's Ratio | Leakoff |
|---|---|---|---|---|---|---|---|---|---|---|---|---|---|
| Top | Bottom | Top | Bottom | | | psi/ft | psi | psi/ft | psi | psi | psi | [ ] | ft/sqrt min |
| 173 | 366 | 0 | 193 | I | Siltstone 1 | 0.434 | 521 | 0.54 | 649 | 1000000 | 1000 | 0.4 | 0.00032 |
| 366 | 472 | 193 | 299 | II | Siltstone 1 | 0.520 | 806 | 0.58 | 905 | 1000000 | 1000 | 0.4 | 0.00032 |
| 472 | 683 | 299 | 510 | III | Siltstone 1 | 0.564 | 1263 | 0.68 | 1516 | 1000000 | 1000 | 0.4 | 0.00032 |
| 683 | 1350 | 510 | 1177 | IV | Mudstone | 0.590 | 2611 | 0.79 | 3502 | 1000000 | 1000 | 0.4 | 0.00032 |

*FIG. 8A*

| TVDRT, m | | TVDBML, m | | Formation | Lithology | Pore Pressure Gradient | Pore Pressure | Fracture Gradient | Minimum Horizontal Stress | Young's Modulus | Fracture Toughness | Poisson's Ratio | Leakoff |
|---|---|---|---|---|---|---|---|---|---|---|---|---|---|
| Top | Bottom | Top | Bottom | | | psi/ft | psi | psi/ft | psi | psi | psi | [ ] | ft/sqrt min |
| 173 | 366 | 0 | 193 | I | Siltstone 2 | 0.434 | 521 | 0.54 | 649 | 500000 | 1000 | 0.4 | 0.00032 |
| 366 | 472 | 193 | 299 | II | Siltstone 2 | 0.520 | 806 | 0.58 | 905 | 500000 | 1000 | 0.4 | 0.00032 |
| 472 | 683 | 299 | 510 | III | Siltstone 2 | 0.564 | 1263 | 0.68 | 1516 | 500000 | 1000 | 0.4 | 0.00032 |
| 683 | 1350 | 510 | 1177 | IV | Mudstone | 0.590 | 2611 | 0.79 | 3502 | 500000 | 1000 | 0.4 | 0.00032 |

*FIG. 9A*

| TVDRT, m | | TVDBML, m | | Formation | Lithology | Pore Pressure Gradient | Pore Pressure | Fracture Gradient | Minimum Horizontal Stress | Young's Modulus | Fracture Toughness | Poisson's Ratio | Leakoff |
|---|---|---|---|---|---|---|---|---|---|---|---|---|---|
| Top | Bottom | Top | Bottom | | | psi/ft | psi | psi/ft | psi | psi | psi | [ ] | ft/sqrt min |
| 173 | 366 | 0 | 193 | I | Silty Claystone 1 | 0.434 | 521 | 0.54 | 649 | 500000 | 1000 | 0.4 | 0.00008 |
| 366 | 472 | 193 | 299 | II | Silty Claystone 1 | 0.520 | 806 | 0.58 | 905 | 500000 | 1000 | 0.4 | 0.00008 |
| 472 | 683 | 299 | 510 | III | Silty Claystone 1 | 0.564 | 1263 | 0.68 | 1516 | 500000 | 1000 | 0.4 | 0.00008 |
| 683 | 1350 | 510 | 1177 | IV | Mudstone | 0.590 | 2611 | 0.79 | 3502 | 500000 | 1000 | 0.4 | 0.00008 |

*FIG. 10A*

| TVDRT, m | | TVDBML, m | | Formation | Lithology | Pore Pressure Gradient | Pore Pressure | Fracture Gradient | Minimum Horizontal Stress | Young's Modulus | Fracture Toughness | Poisson's Ratio | Leakoff |
|---|---|---|---|---|---|---|---|---|---|---|---|---|---|
| Top | Bottom | Top | Bottom | | | psi/ft | psi | psi/ft | psi | psi | psi | [ ] | ft/sqrt min |
| 173 | 366 | 0 | 193 | I | Mudstone | 0.434 | 521 | 0.54 | 649 | 1000000 | 3000 | 0.4 | 0.00008 |
| 366 | 472 | 193 | 299 | II | Mudstone | 0.520 | 806 | 0.58 | 905 | 1000000 | 3000 | 0.4 | 0.00008 |
| 472 | 683 | 299 | 510 | III | Mudstone | 0.564 | 1263 | 0.68 | 1516 | 1000000 | 3000 | 0.4 | 0.00008 |
| 683 | 1350 | 510 | 1177 | IV | Mudstone | 0.590 | 2611 | 0.79 | 3502 | 1000000 | 3000 | 0.4 | 0.00008 |

*FIG. 11A*

| TVDRT, m | | TVDBML, m | | Formation | Lithology | Pore Pressure Gradient | Pore Pressure | Fracture Gradient | Minimum Horizontal Stress | Young's Modulus | Fracture Toughness | Poisson's Ratio | Leakoff |
|---|---|---|---|---|---|---|---|---|---|---|---|---|---|
| Top | Bottom | Top | Bottom | | | psi/ft | psi | psi/ft | psi | psi | psi | [ ] | ft/sqrt min |
| 173 | 366 | 0 | 193 | I | Silty Claystone 2 | 0.434 | 521 | 0.54 | 649 | 439216 | 1000 | 0.4 | 0.00008 |
| 366 | 472 | 193 | 299 | II | Silty Claystone 2 | 0.520 | 806 | 0.58 | 905 | 543137 | 1000 | 0.4 | 0.00008 |
| 472 | 683 | 299 | 510 | III | Silty Claystone 2 | 0.564 | 1263 | 0.68 | 1516 | 750000 | 1000 | 0.4 | 0.00008 |
| 683 | 1350 | 510 | 1177 | IV | Mudstone | 0.590 | 2611 | 0.79 | 3502 | 1000000 | 1000 | 0.4 | 0.00008 |

*FIG. 12A*

| TVDRT, m | | TVDBML, m | | Formation | Lithology | Pore Pressure Gradient | Pore Pressure | Fracture Gradient | Minimum Horizontal Stress | Young's Modulus | Fracture Toughness | Poisson's Ratio | Leakoff |
|---|---|---|---|---|---|---|---|---|---|---|---|---|---|
| Top | Bottom | Top | Bottom | | | psi/ft | psi | psi/ft | psi | psi | psi | [ ] | ft/sqrt min |
| 173 | 366 | 0 | 193 | I | Silty Claystone 1 | 0.434 | 521 | 0.54 | 649 | 500000 | 1000 | 0.4 | 0.00008 |
| 366 | 472 | 193 | 299 | II | Silty Claystone 1 | 0.520 | 806 | 0.58 | 905 | 500000 | 1000 | 0.4 | 0.00008 |
| 472 | 683 | 299 | 510 | III | Silty Claystone 1 | 0.564 | 1263 | 0.68 | 1516 | 500000 | 1000 | 0.4 | 0.00008 |
| 683 | 1350 | 510 | 1177 | IV | Mudstone | 0.590 | 2611 | 0.79 | 3502 | 500000 | 1000 | 0.4 | 0.00008 |

*FIG. 13A*

| Case | Lithology | Leakoff (ft/sqrt min) | Young's modulus (psi) | Frac Toughness (psi) | Poisson's Ratio | Volume until breach (rounded), bbl |
|---|---|---|---|---|---|---|
| 1 | Siltstone 1 | 0.00032 | 1,000,000 | 1000 | 0.4 | 6400 |
| 2 | Siltstone 2 | 0.00032 | 500,000 | 1000 | 0.4 | 5860 |
| 3 | Silty Claystone 1 | 0.00008 | 500,000 | 1000 | 0.4 | 3000 |
| 4 | Mudstone 1 | 0.00008 | 1,000,000 | 3000 | 0.4 | 3500 |
| 5 | Silty Claystone 2 | 0.00008 | 250,000 at Top Linearly increasing to 750,000 at Bottom (20" shoe) and further below | 1000 | 0.4 | 3200 |
| 3 @ 17 BPM | Silty Claystone 1 | 0.00008 | 500,000 | 1000 | 0.4 | 5000 |

*FIG. 14*

MODELING AND ANALYSIS OF HYDRAULIC FRACTURE PROPAGATION TO SURFACE FROM A CASING SHOE

BACKGROUND

There is a significant risk of creating a shallow hydraulic fracture breaching to surface or seabed during well kill or control operations. When shallow gas is encountered while drilling, a heavy mud is pumped into the well for well control. The injection of heavy mud leads to a pressure build-up downhole and, in most situations, the pressure may exceed the formation fracture gradient, resulting in hydraulic fracture of the formation. Furthermore, as some of the injected mud enters the newly created fracture, the fracture may grow larger. If a significant volume of heavy mud is pumped into the well, the hydraulic fracture may reach the surface or seabed, creating a crater or depression on the surface or seabed nearby the rig. Under this scenario, platform stability may be compromised. Furthermore, fracture breach to the surface or seabed may lead to serious environmental impact. The risk of the above scenario is particularly great for wells that may have a high probability of encountering shallow gas and/or when overburden is represented by weak and/or unconsolidated formations.

BRIEF DESCRIPTION OF DRAWINGS

FIGS. 7A-7B show examples of operational and geomechanical data in accordance with one or more embodiments disclosed herein.

FIGS. 8A-8C show an example of a geomechanical model and a simulation of a hydraulic fracture in accordance with one or more embodiments disclosed herein.

FIGS. 9A-9C show an example of a geomechanical model and a simulation of a hydraulic fracture in accordance with one or more embodiments disclosed herein.

FIGS. 10A-10C show an example of a geomechanical model and a simulation of a hydraulic fracture in accordance with one or more embodiments disclosed herein.

FIGS. 11A-11C show an example of a geomechanical model and a simulation of a hydraulic fracture in accordance with one or more embodiments disclosed herein.

FIGS. 12A-12C show an example of a geomechanical model and a simulation of a hydraulic fracture in accordance with one or more embodiments disclosed herein.

FIGS. 13A-13C show an example of a geomechanical model and a simulation of a hydraulic fracture in accordance with one or more embodiments disclosed herein.

FIG. 14 shows a summary of operational parameters in accordance with one or more embodiments disclosed herein.

DETAILED DESCRIPTION

Figure 1:
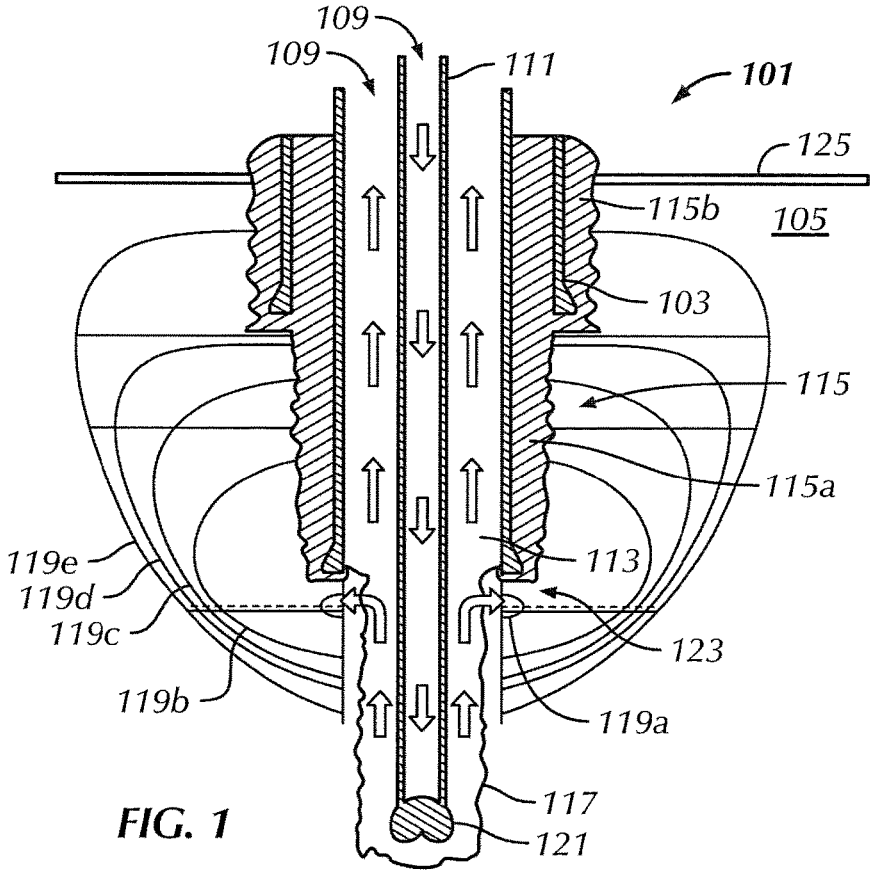
FIG. 1 shows a system including a drilling subsystem in accordance with one or more embodiments disclosed herein.

Specific embodiments of the present disclosure will now be described in detail with reference to the accompanying figures. Like elements in the various figures are denoted by like reference numerals for consistency.

In the following detailed description, numerous specific details are set forth in order to provide a more thorough understanding of the embodiments disclosed. However, it will be apparent to one of ordinary skill in the art that the embodiments disclosed may be practiced without these specific details. In other instances, well-known features have not been described in detail to avoid obscuring detailed of the embodiments discussed.

Hydraulic fracture containment may be used for well control operations, environmental protection and for shallow gas contingency planning and design. In general, embodiments of the present disclosure relate to methods and apparatus for determining volume and operational parameters of well control operations. As used herein well control operations refer to operations relating to the pumping of mud into a well in order to keep formation fluids, e.g., oil and gas, from entering the wellbore. Well control operations may be employed while drilling. As used herein, well control operations include both static and circulating well kill operations. Methods and apparatus for determining operational parameters for well control operations in accordance with embodiments disclosed herein include modeling and analysis of the propagation of a hydraulic fracture initiated at surface casing shoe. The modeling and analysis may employ a hydraulic fracture numerical simulator in conjunction with a geomechanical model. In accordance with one or more embodiments, the methods and apparatus provide for the determination of a range of mud volumes that may be safely pumped into a well at a given rate before a hydraulic fracture reaches the surface or seabed.

In one aspect, embodiments disclosed herein relate to a method of designing a well control operation. The method includes obtaining sub-surface data related to a formation surrounding a well, building a geomechanical model of the formation based on the sub-surface data, obtaining operational data related to the well control operation, performing, on a processor, a hydraulic fracture simulation of the formation, wherein the simulation is based on the operational data and the geomechanical model and determining an estimated volume of fluid required for a fracture to breach an upper surface of the formation.

In another aspect, embodiments disclosed herein relate to a system for designing a well control operation. The system includes a processor, a memory, a geomechanical model generating module configured to generate a geomechanical model of a sub-surface formation surrounding the well. The system further includes an operational data generating module configured to generate operational data comprising at least one input parameter for a fracturing simulation executing on the processor, wherein the simulation is based on operational data relating to a well control type, and a simulating module configured to perform the hydraulic fracturing simulation based upon the geomechanical model and the operational data, wherein the simulating module is configured to determine an estimated volume of fluid required for a fracture to breach an upper surface of the sub-surface formation.

In certain embodiments, embodiments of the present disclosure relate to methods and apparatus for providing hydraulic fracture containment assurance verification for shallow fractures. Specifically, when shallow gas is encountered when drilling a section below surface casing, heavy mud is pumped into the well for well control which may lead to initiation of hydraulic fracture at surface casing shoe. Because the surface casing is set at shallow depth, i.e., about 500 m-600 m below the seabed or ground surface, there is a risk that a fracture may propagate to the seabed or ground surface. Thus, the present disclosure provides methods and apparatus to model and simulate the shallow hydraulic fracture propagation, determine or estimate a mud volume that, when pumped downhole for well control, causes the hydraulic fracture to breach to seabed or surface, and determine or estimate a maximum volume of mud to be pumped downhole for well control that assures the operator that the seabed or surface will not be breached (e.g., by applying a safety factor to the determined volume that caused the fracture to breach the seabed/surface).

FIG. 1 shows a system in accordance with one or more embodiments of the present disclosure. The system includes drilling subsystem 101 which is used to drill a well 103 in formation 105. Drilling and well control is further facilitated by drilling fluid 109, often referred to as mud, which may lubricate bit 121 as well as supply the hydrostatic pressure for a well control or kill operation. In one example of a well control operation, fluid 109 may be pumped down the drill string 111 and allowed to circulate back through the annulus 113, e.g., during a circulating well kill operation. In another example of a well control operation, e.g., during a static well kill operation (not shown), fluid 109 may be pumped down both the drill string 111 and the annulus 113. As used herein, annulus 113 refers to both the space between the drill string 111 and the casing 115 as well as the annular space between the open borehole 117 and the drill string 111.

Casing segments 115*a* and 115*b* serve to ensure the structural integrity of the wellbore and the surrounding formation. In accordance with one or more embodiments of the present disclosure, a well control operation may result in an initiation of a hydraulic fracture 119*a* at the casing shoe 123 due to the increased equivalent circulating density and increased hydrostatic pressure of the drilling fluid 109. The size and shape of the fracture 119*a* depends on the pressure created downhole, the volume injected, the geophysical properties of the formation 105 and properties of the injected mud. For example, continued pumping of mud into the well after the fracture initiation at the casing shoe may cause the fracture to grow in size, represented by fracture contours 119*a*-119*e*, until at some threshold pressure, the fracture breaches the surface or seabed 125.

In accordance with one or more embodiments, the drilling subsystem 101 is associated with sensors, drilling equipment (e.g., pumps, motors, compressors), and other elements used to control the fluid and/or direct bit 121 during drilling. Generally, drilling operations in conjunction with other production operations are referred to herein as field operations. These field operations may be performed as directed by a surface module (not shown) as described in more detail below. In accordance with one or more embodiments of the present disclosure, the surface module may include, or function in conjunction with, a hydraulic fracture numerical simulator that models and analyzes the hydraulic fracture propagation from the surface casing shoe. The hydraulic fracture numerical simulator in accordance with embodiments disclosed herein may be used to design a well kill operation before drilling commences. In accordance with one or more embodiments, the well control operation is conducted by pumping a volume of mud into the well, wherein the volume of the mud pumped falls below a threshold range of mud volumes computed by the hydraulic fracture simulator. Accordingly, the well may be controlled safely with a reduced risk that the hydraulic fracture will reach the surface or seabed.

Figure 2:
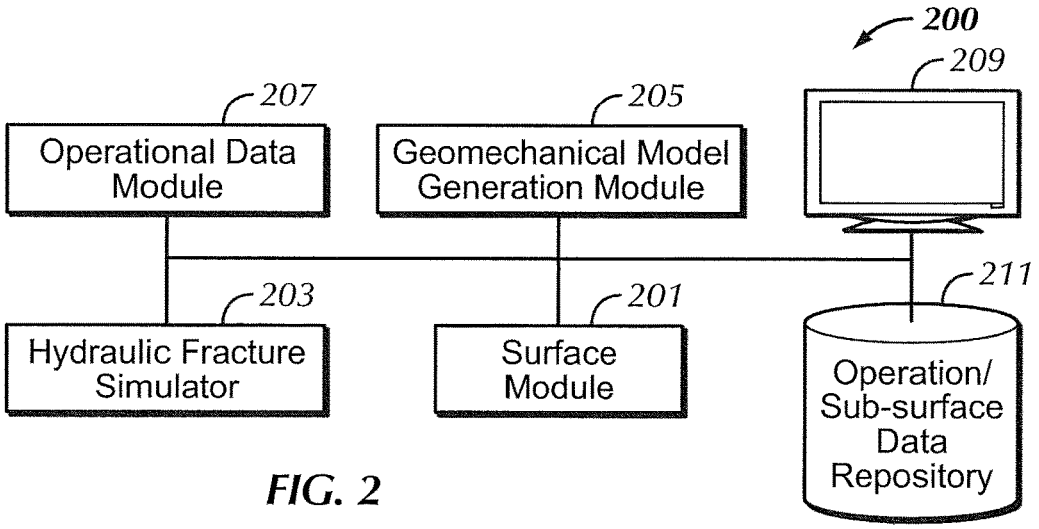
FIG. 2 shows a system for determining operational parameters for well control operations in accordance with one or more embodiments disclosed herein.

FIG. 2 shows a system 200 for determining operational parameters for well control operations that includes modeling and analysis of hydraulic fracture propagation from a surface casing shoe in accordance with one or more embodiments disclosed herein. In one or more embodiments, one or more of the modules and elements shown in FIG. 2 may be omitted, repeated, and/or substituted. Accordingly, embodiments of system 200 for determining operational parameters for well control operations should not be considered limited to the specific arrangements of modules shown in FIG. 2.

As shown in FIG. 2, the system 200 may include surface module 201, hydraulic fracture simulator 203, geomechanical model generating module 205, operational data generating module 207, display 209, and operational/sub-surface data repository 211. In accordance with one or more embodiments, surface module 201, hydraulic fracture simulator 203, geomechanical model generating module 205, operational data generating module 207, display 209, and operational/sub-surface data repository 211 may be operatively and/or communicatively linked by any means known in the art. Accordingly, every component may send, receive, or otherwise exchange data with every other component. Each of these components is described in more detail below.

In accordance with one or more embodiments of the present disclosure, surface module 201 may be used to communicate with tools (such as drilling equipment) and/or offsite operations (not shown). For example, the surface module 201 is used to send and receive data, to send instructions downhole, to control tools, and may also receive data gathered by sensors (not shown) and/or other data collection sources for analysis and other processing. The data received by the surface module may be subsequently stored in, or sent from an operational/sub-surface data repository 211 which may be any type of storage module and/or device (e.g., a file system, database, collection of tables, or any other storage mechanism) for storing data. Furthermore, data generated by the hydraulic fracture simulator 203 and/or stored in the operational sub-surface data repository 211 may be used by the surface module 201 to modify the physical operation and parameters of a drilling or well control operation.

In one or more embodiments, the surface module 201 may be operatively coupled to a well, e.g., well 103 shown in FIG. 1, as well as other wells, in the oilfield. In particular, the surface module 201 is configured to communicate with one or more elements of the oilfield (e.g., sensors, drilling equipment, etc.), to send commands to the elements of the oilfield, and to receive data therefrom. For example, in an effort to control the well after a kick, the drilling and well control equipment (e.g., a pump) may be used to inject the drilling fluid into the annulus and/or drill string may be adjusted to mitigate or control the flow of shallow gas into the wellbore based on a command sent by the surface module 201. In one or more embodiments, the commands sent by surface module 201 to the drilling and well control equipment are based on one or more operational parameters generated by the hydraulic fracture simulation performed by the system for determining operational parameters for well control operations described above. In particular, the state of various drilling and well control equipment, such as the pump rate and total volume of fluid pumped into the well may be adjusted by the operational parameters generated by the simulation procedure, thereby adjusting the well control operation in the oilfield.

The surface module 201 may be located at the oilfield (not shown) and/or remote locations. The surface module 201 may be provided with computer facilities for receiving, storing, processing, and/or analyzing data from the elements of the oilfield. The surface module 201 may also be provided with functionality for actuating elements at the oilfield. The surface module 201 may then send command signals to the oilfield in response to data received, for example, to mitigate or control the flow of shallow gas into the annulus.

System 200 further includes operational data module 207. Operational data module 207 generates, receives, and/or processes operational data relating to the well control operation. The operational data may be transferred from, for example, the operational/sub-surface data repository 211 or may be obtained directly from a well operator. In accordance with one or more embodiments disclosed herein, the operational data may be input into the operational data module 207 by a user or may be transferred from the operational/sub-surface data repository 211 upon a request from a user. For example, operational data may include fluid rheological properties (fluid density, fluid viscosity, fluid yield point, etc.), casing properties (casing size, burst and collapse pressures, casing segment depths, etc.), and the expected range of pump rates for the fluid used in the well control operation. One of ordinary skill will appreciate that any known operational parameter relating to a well control operation may be generated, received, and/or processed by operational data module 207.

System 200 further includes geomechanical model generation module 205. In accordance with one or more embodiments, geomechanical model generation module 205 may receive sub-surface data (e.g., obtained from well logging instruments, measurement/logging while drilling instruments, results of well testing, etc.), that relates to the formation surrounding the well and process this data to generate a geomechanical model based on the received sub-surface data. The sub-surface data may be transferred to geomechanical model generation module 205 from, for example, the operational/sub-surface data repository 211 or may be obtained directly from a well operator. In accordance with one or more embodiments disclosed herein, the sub-surface data may be input into the geomechanical model generation module 205 by a user or may be transferred from the operational/sub-surface data repository 211 upon a request from a user. The sub-surface data used to generate a geomechanical model may include formation lithostratigraphy, pore pressure data, fracture gradients data, leakoff test data, formation integrity test data, regional tectonics, geomechanical data/stress regimes, and other general rock properties that may aid in the development of the geomechanical model. Furthermore, in accordance with one or more embodiments, the geomechanical model generating module may calculate formation characteristics based on the sub-surface data and these calculated formation characteristics may further aid in the development of the geomechanical model. For example, the in-situ stress direction (horizontal or vertical), fracture propagation plane, or in-situ stress profiles may be calculated based upon the sub-surface data.

System 200 further includes hydraulic fracture simulator 203 that may use the aforementioned operational data and geomechanical model from geomechanical model generating module 205 and operational data generating module 207 to simulate the hydraulic fracture creation and propagation through the formation. In one embodiment, a geomechanical hydraulic fracturing model is used to compute the range of fluid volumes required to cause the fracture to breach the surface or seabed. In one embodiment, the hydraulic fracturing may be simulated using a system such as TerraFRAC™ (TerraFRAC is a trademark of TerraTEK, A Schlumberger Company). Hydraulic fracture numerical simulators use formation lithostratigraphy, pore pressure data, fracture gradients data, leakoff test data, formation integrity test data, regional tectonics, geomechanical data/stress regimes, and other general rock properties in the geomechanical model to run hydraulic fracture simulations. Depending on different combinations of these properties and injection parameters the hydraulic fracture simulations provide the hydraulic fracture extension (e.g., height, length and width) in the formation(s). Those skilled in the art will appreciate that any type of numerical fracture simulation may be used and, thus, the present disclosure is not limited to the techniques, models, and methods employed within the TerraFRAC™ software package. Other commercially available hydraulic fracturing simulators include, for example, FracCADE® by Schlumberger (Houston, Tex.), and MFRAC™ by Meyer and Associates, Inc. (Natrona Heights, Pa.). The model may include numerical modeling, two dimensional modeling, three-dimensional modeling, and may simulate the growth of fractures during a well control operation.

System 200 further includes display 209 for data visualization and interpretation by a user. Accordingly, operational data module 207, geomechanical model generation module 205, and hydraulic fracture simulator 203, may processes data into a form that allows a user to view and interact with the data. In accordance with one or more embodiments of the present disclosure, the display 209 may include a graphical user interface (GUI) for interacting with the user. The GUI may include functionality to detect commands from a user and update the data accordingly. For example, in one or more embodiments of the present disclosure, the GUI includes functionality to receive a set of numbers corresponding to operational data and/or sub-surface data. Further, in one or more embodiments of the present disclosure, the GUI may include various user interface components, such as buttons, checkboxes, drop-down menus, etc. Accordingly, a user with minimal computer and/or specialized knowledge relating to the details of hydraulic fracture simulation may analyze the results presented by the system for determining operational parameters for well control operations in accordance with one or more embodiments of the present disclosure. Furthermore, display 209 may be a monitor (e.g., Cathode Ray Tube, Liquid Crystal Display, touch screen monitor, etc.) or any other object that is capable of presenting data.

Those skilled in the art will appreciate that the aforementioned components are logical components, i.e., logical groups of software and/or hardware components and tools that perform the aforementioned functionality. Further, those skilled in the art will appreciate that the individual software and/or hardware tools within the individual components are not necessarily connected to one another. In addition, while the interactions between the various components shown in FIG. 2 correspond to transferring information from one component to another component, there is no requirement that the individual components are physically connected to one another. Rather, data may be transferred from one component to another by having a user, for example, obtain a printout of data produced by one component and entering the relevant information into another component via an interface associated with that component. Further, no restrictions exist concerning the physical proximity of the given components within the system.

Figure 3:
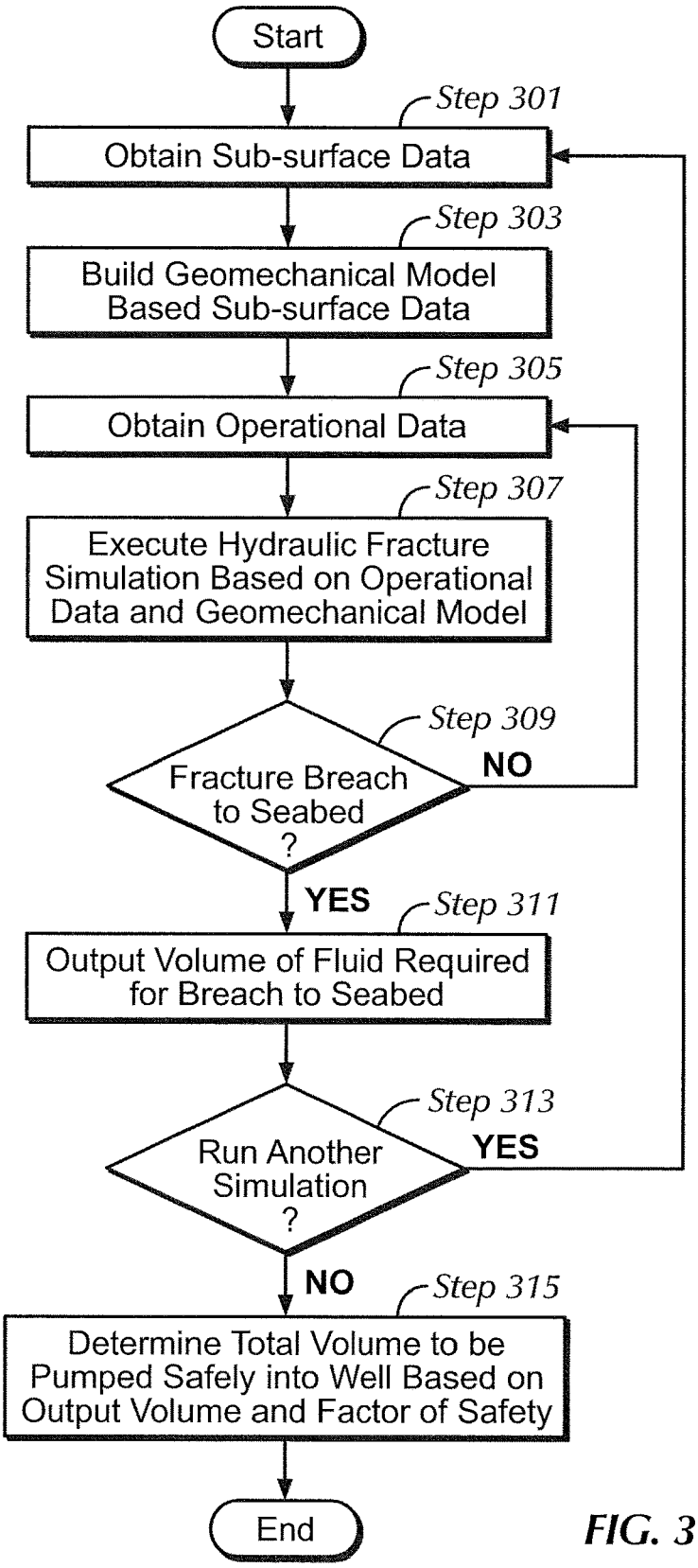
FIG. 3 shows a flow chart of a method for determining operational parameters for well control operations in accordance with one or more embodiments disclosed herein.

FIG. 3 shows a flow chart in accordance with one embodiment of the present disclosure. More specifically, FIG. 3 shows a method for determining operational parameters for well control operations. In Step 301, sub-surface data is obtained. As described above, the sub-surface data may be obtained via data transfer from the operational/sub-surface data repository 211 or may be obtained directly from a well operator/contingency planner. Data obtained directly from the well operator/contingency planner may be input directly by a user or transferred from a remote storage location in accordance with any data transfer method known in the art. As noted above, sub-surface data may include formation lithostratigraphy, shallow pore pressure data, fracture gradients data, leakoff test data, formation integrity test data, regional geomechanical data/stress regimes, and other general rock properties that may aid in the development of the geomechanical model.

In Step 303, the sub-surface data is used to build a geomechanical model of the formation surrounding the borehole. In accordance with one or more embodiments disclosed herein, the geomechanical model is a numerical model represented by data that may be stored in the operational/sub-surface data repository 211, geomechanical model generation module 205, or may be stored remotely in accordance with data storage methods known in the art. The geomechanical model itself may be generated by the geomechanical model generation module 205 based on the subsurface data. Examples of geomechanical models employed in accordance with embodiments disclosed herein are shown in greater detail in FIGS. 8-13.

In Step 305, operational data is obtained. The operational data may be obtained through data transfer from, for example, the operational/sub-surface data repository 211 or may be obtained directly from a well operator/contingency planner. Data obtained directly from the well operator/contingency planner may be input directly by a user or transferred from a remote storage location in accordance with any data transfer method known in the art. In accordance with one or more embodiments disclosed herein, the operational data may be input into the operational data module 207 by a user or may be transferred from the operational/sub-surface data repository 211 upon a request from a user. As noted above, operational data relates to the details of the well drilling or control operation and may include mud properties (e.g., mud makeup, mud density), casing properties (e.g., casing sizes and segment depths), and the expected range of pump rates for the mud used in the well control operation. Examples of operational data used in accordance with embodiments disclosed herein are discussed in more detail below in reference to FIGS. 8-13.

In Step 307, the geomechanical model and operational parameters are input into a hydraulic fracture simulator and a hydraulic fracture simulation is executed. This hydraulic fracture simulation results in a simulated hydraulic fracture, as shown in FIGS. 8-13 described in more detail below. In one embodiment, the hydraulic fracturing may be numerically simulated using the TerraFRAC™ (TerraFRAC is a trademark of TerraTEK, A Schlumberger Company) software platform.

In Step 309, the simulated fracture is inspected to determine if the fracture has reached the surface or seabed. If the fracture has not reached the seabed, the method returns to Step 305 where new operational data is obtained. For example, the new operational data may include a new volume of fluid and/or a new pump rate to be pumped into the well and the same rate used for the previous iteration. Alternatively, if it is determined at Step 309 that the fracture has breached to the surface or seabed, the method proceeds to Step 311 where the operational parameters are output. For example, the flow rate and total volume pumped into the well may be output in addition to the data relating to the physical size and shape of the fracture.

At Step 313, if it is determined that another simulation is desired, the method returns to Step 301. At Step 301, new sub-surface data is obtained and the method proceeds as before. By changing the sub-surface data for each iteration of the method, the method may be used to produce an estimated range for the operational parameters that result in a fracture breach to the surface or seabed. The range of sub-surface data may reflect uncertainty based on lack of knowledge relating to the actual sub-surface formation being simulated.

In Step 315, the control volume is determined. As used herein, the control volume is an operational parameter that represents the volume of fluid to be pumped into the well during a well control operation (e.g., circulating or static well kill operation) that results in a low risk that the pumping of fluid will result in a fracture breach to surface or seabed. Thus, the control volume may be calculated to be a total volume that is below the estimated range of volumes that result in a fracture breach to surface or seabed. In accordance with one or more embodiments disclosed herein, the control volume may be determined by employing a factor of safety in conjunction with the estimated range of fluid volume that results in a fracture breach to the surface or seabed. Thus, in accordance with embodiments disclosed herein, the control volume may be determined by multiplying or dividing a volume within the range of determined volumes by a factor of safety less than or greater than 1, respectively.

Figure 4:
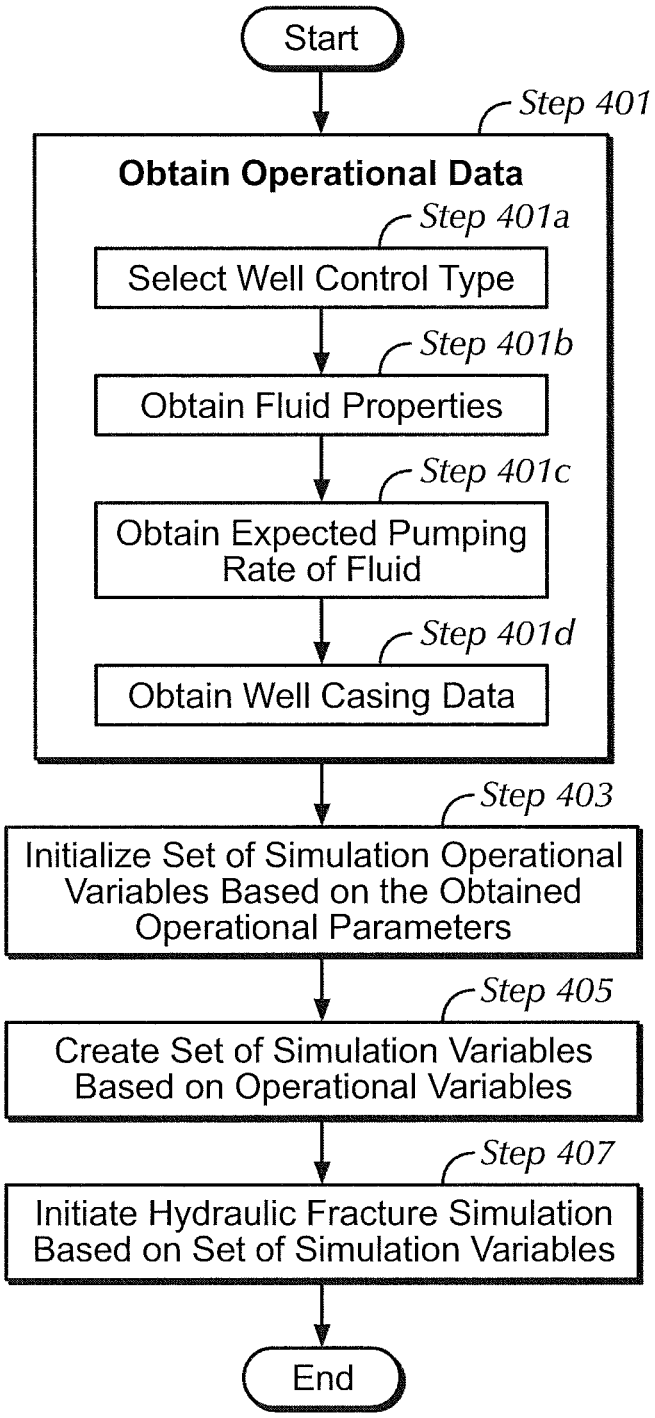
FIG. 4 shows a flow chart for obtaining operational data in accordance with one or more embodiments disclosed herein.

FIG. 4 shows a flow chart in accordance with one or more embodiments of the present disclosure. More specifically, FIG. 4 shows additional details relating to Step 305 of FIG. 3 for obtaining operational data for subsequent use in a method for determining operational parameters for well control operations. In Step 401, the operational data related to the well control or kill operation is obtained. Step 401 may be further subdivided into steps 401*a*-401*d* wherein, at Step 401*a*, the well control type (e.g., circulating or static well kill operation) is selected, at Step 401*b*, the mud rheological properties (e.g. mud density, mud viscosity, mud yield point, etc.) are selected, at Step 401*c*, the expected range of mud pumping rate is obtained, and at Step 401*d*, the well casing data (e.g., casing segment depth, thickness, burst and collapse pressures, etc.) is obtained. In Step 403, a set of simulation operational variables is initialized based on the obtained operational parameters. In Steps 405 and 407, a hydraulic fracture simulation is initiated based on the created set of simulation operational variables including pump rate and injection volumes.

Figure 5:
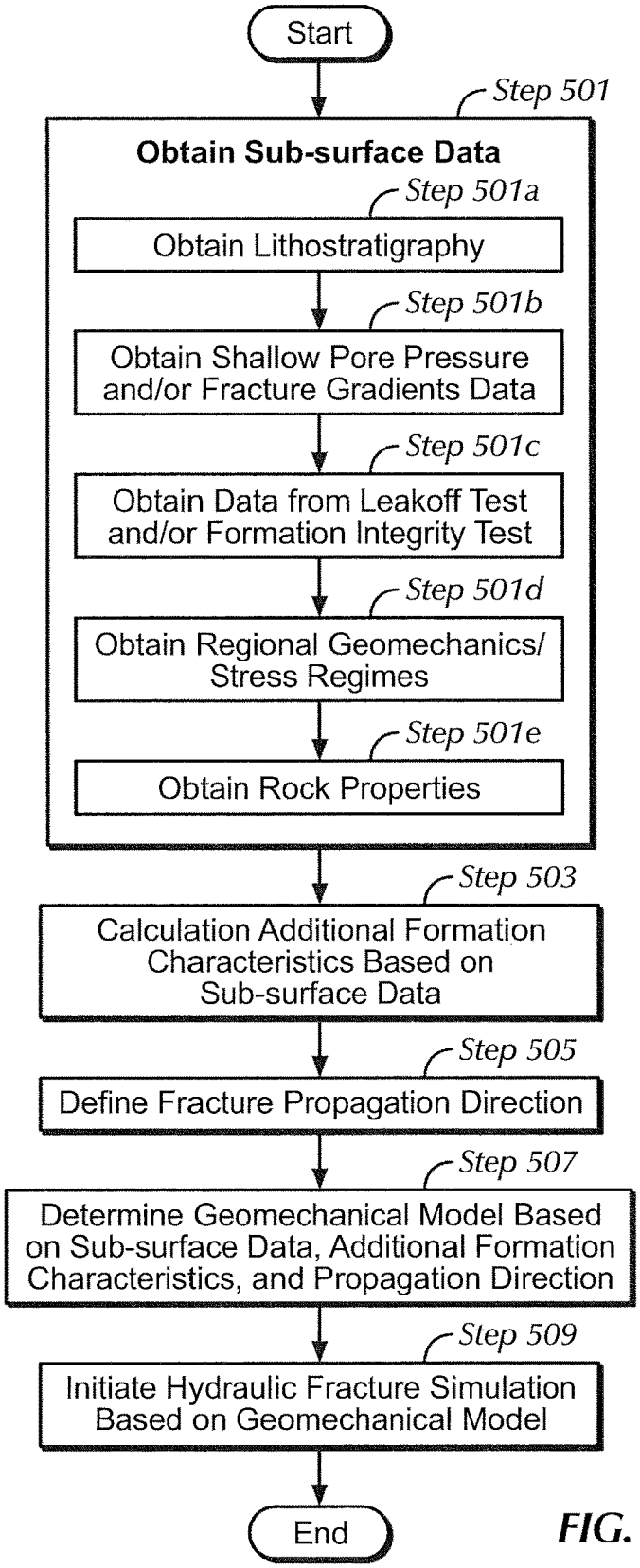
FIG. 5 shows a flow chart for obtaining sub-surface data related to a formation surrounding a well in accordance with one or more embodiments disclosed herein.

FIG. 5 shows a flow chart in accordance with one or more embodiments of the present disclosure. More specifically, FIG. 5 shows additional details relating to Steps 301-303 of FIG. 3 for obtaining sub-surface data related to the formation surrounding the well for subsequent use in a method for determining operational parameters for well control operations. In Step 501, the sub-surface data is obtained. Step 501 may be further subdivided into Steps 501*a*-501*d* wherein, at Step 501*a*, the formation lithostratigraphy is obtained, at Step 501*b*, the shallow pore pressure and/or fracture gradients data are obtained, at Step 501*c*, the data from leakoff tests and/or formation integrity tests is obtained, at Step 501*d*, the regional geomechanics/stress regimes data is obtained, and at Step 501*e*, the rock property data is obtained. Examples of various types of subsurface data are shown in FIGS. 7A, 8A, 9A, 10A, 11A, 12A, and 13A.

In Step 503, additional formation characteristics may be calculated based on the sub-surface data. For example, the in situ vertical and horizontal stress profiles may be calculated based on the sub-surface data. As one of ordinary skill in the art will appreciate, vertical in situ stress or overburden may be calculated by multiplying the depth of the formation and the rock density of the formations, and adding the load on all of the formations above a specific formation layer. In other words, the vertical in situ stress or overburden is the total load from above acting on a specific underlying formation. Horizontal minimum and maximum stresses may be calculated using Poisson's ratio, pore pressure, vertical stress and Biot's constant. Young's modulus and tectonic maximum and minimum strain may also be used for horizontal stress calculation if the formation is located in a tectonically active area.

In Step 505, the fracture propagation direction is defined as a result of investigation of sub-surface formations and stress regime (e.g., vertical fracture or horizontal fracture). In Step 507, a geomechanical model is determined based on the available sub-surface data, the additional formation characteristics, and the propagation direction. In Step 509, the hydraulic fracture simulation is initiated based on the geomechanical model.

Figure 6:
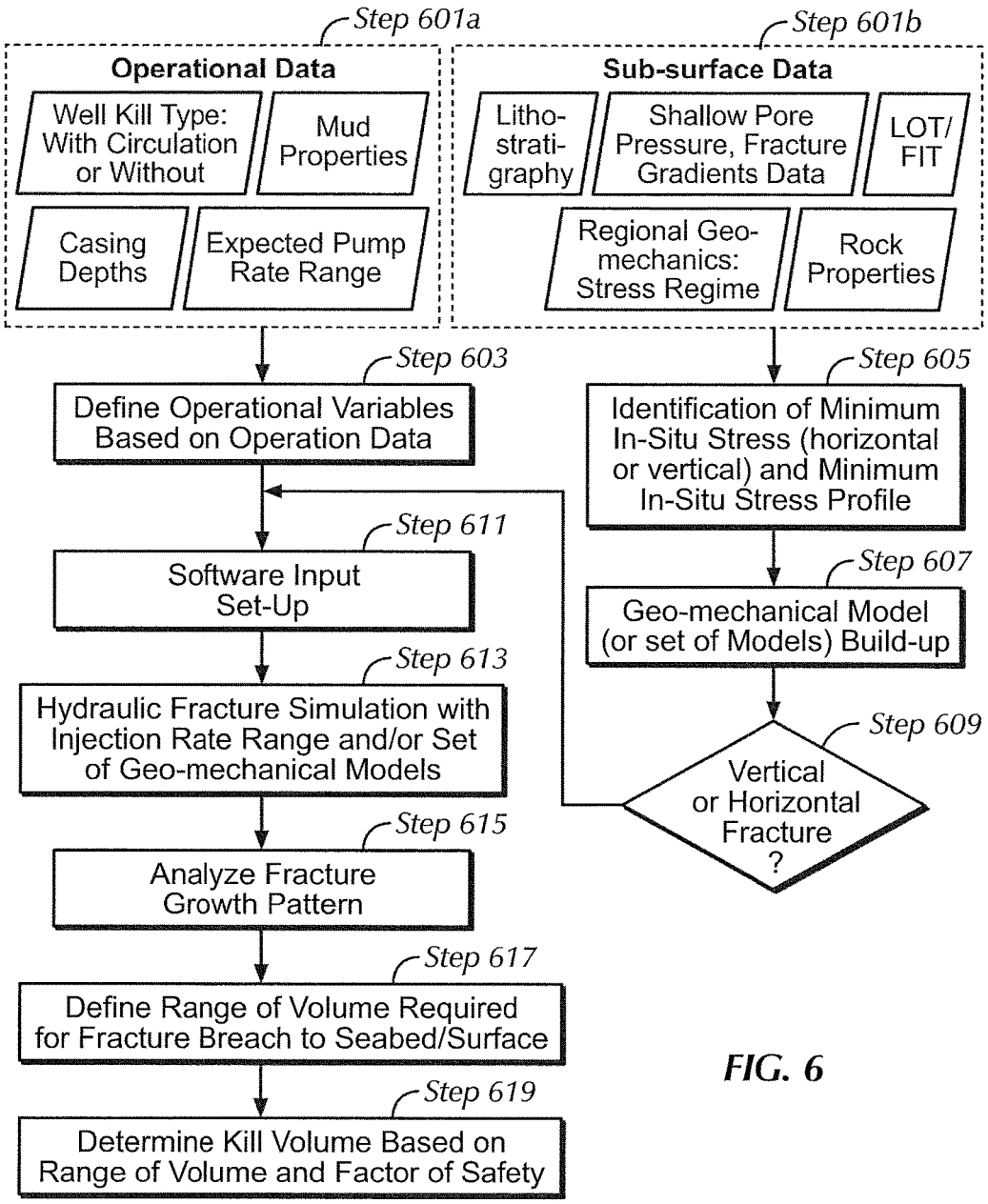
FIG. 6 shows a flow chart of a method for determining the volume of mud required for a fracture to breach the surface or seabed during a well kill operation in accordance with one or more embodiments disclosed herein.

FIG. 6 shows a flow chart in accordance with one or more embodiments of the present disclosure. More specifically, FIG. 6 shows a method for determining the volume of mud required for a fracture to breach the surface or seabed during a well kill operation in accordance with one or more embodiments disclosed herein. In Steps 601*a* and 601*b*, operational data and sub-surface data are obtained, respectively. The operational and sub-surface data may be transferred from, for example, the operational/sub-surface data repository 211 or may be obtained directly from a well operator. In accordance with one or more embodiments disclosed herein, the operational and sub-surface data may be input into the operational data module 207 by a user or may be transferred from the operational/sub-surface data repository 211 upon a request from a user.

In accordance with one or more embodiments, the operational data may include the well kill type (e.g., with or without circulation), mud properties, casing depths, and expected mud pump rate range. In accordance with one or more embodiments, the sub-surface data may include the lithostratigraphy, shallow pore pressure, fracture gradients data, leak off test (LOT) and formation integrity test (FIT) data, regional geomechanical data (e.g., stress regime, and rock properties). Examples of sub-surface and operational data are described in more detail below in reference to FIGS. 7-14.

In Step 603, operational variables are defined based on the operational data. For example, the injection depth is defined as the depth of deepest casing shoe, the fluid injection rate range is defined, e.g., 100% to 10% of the expected pump rate range, and the injection fluid properties are defined.

In Step 605, the minimum in situ stress (horizontal or vertical) and/or minimum in situ stress profile are identified based on the sub-surface data. In step 607, one or more geomechanical models are built. In Step 609 the propagation direction of the fracture is identified (e.g., vertical or horizontal). In Step 611, the simulation software is initialized. The simulation software may employ any simulation method known in the art, for example, a planar 3D finite element simulation method, such as that employed by the TerraFRAC™ software platform. In Step 613, the fracture propagation is simulated based on the operational data and the geomechanical models. In Step 615, the fracture growth pattern is analyzed, e.g., to determine if the fracture has breached the seabed or surface. In Step 617, the range of volume of mud required for the fracture to breach to the surface or seabed is determined.

In Step 619, the kill volume may be determined. As used herein, the kill volume is an operational parameter representing the volume of mud to be pumped into the well to safely kill the well, i.e., without creating a fracture breach to surface/seabed. The kill volume may be calculated to be a total volume of mud that is below the estimated range of volumes that result in a fracture breach to surface or seabed. In accordance with one or more embodiments disclosed herein, the kill volume may be determined by employing a factor of safety in conjunction with the calculated volume of mud required for the fracture to breach to the surface or seabed. Thus, in accordance with embodiments disclosed herein, the kill volume may be determined by multiplying or dividing the volume of mud required for the fracture to breach to the surface or seabed by a factor of safety less than or greater than 1, respectively.

FIGS. 7-14 show the results of modeling and analysis of hydraulic fracture propagation from a surface casing shoe in accordance with one or more embodiments disclosed herein. More specifically, FIGS. 7-14 show a summary of the results for the modeling and analysis under 6 different example cases having different geomechanical models and/or different operational parameters. The results summarized in FIGS. 7-14 are the result of running the hydraulic fracture simulation under operational conditions that have been determined to lead to a breach to the surface or seabed of the hydraulic fracture. Each case is described in more detail below. Each case shown in FIGS. 7-14 was for a hydraulic fracture initiated at the casing shoe of the well. The purpose of these simulations was to define the mud injection volume that would result in hydraulic fracture breaching to seabed. The simulations were run using M-I SWACO WI Toolbox that integrates fully 3D TerraFRAC™ hydraulic fracture simulator software. Furthermore, for all simulations, a vertical 20 inch casing is set at 683 m true vertical depth below rotary table (TVDBRT). A sidetrack 17½ inch hole was drilled from a kick off point (KOP) 20 m below the shoe and 1350 m TVDBRT. Furthermore, the interval between 683 m and 1359 m is openhole. This simulation employed a static well control operation and, thus, the valves are closed (no circulation and returns) and 1.46 SG mud is pumped into the closed system. As a result of the increasing pressure, a fracture occurs and the mud flows through the fracture into the formation.

The operational parameters used in the example simulation to characterize the mud include pump rate, mud weight (MW), mud plastic viscosity (PV), yield point (YP), power law model coefficients n and K, and viscosity. Examples of values used for the sub-surface and operational parameters are shown in FIGS. 7A and 7B, respectively. In accordance with one or more embodiments disclosed herein, the input geotechnical data, injected fluid parameters and injection rate are provided by the customer. In addition, the customer may provide pore pressure/fracture gradient (PPFG) data. Using this data, the stress calculated for each layer may be used as minimum horizontal stress $\sigma_{Hmin}$ input. Pore pressure may also be set up using PPFG data.

For the simulation results presented below in FIGS. 8-14, the geomechanical model includes four layers according to litho-stratigraphy: Formation I from 173 m TVDRT to 366 TVDRT, Formation II from 366 m TVDRT to 472 m TVDRT, Formation III from 472 m to 683 m TVDRT and Formation IV from 683 m TVDRT to 1350 TVDRT.

Fracture simulations were performed until fracture approached the seabed. Further running of simulations was stopped for quality control because at very shallow depth, the calculations may become unstable. An increased fracture width towards the seabed indicates a fracture breach situation.

Figure 8B:
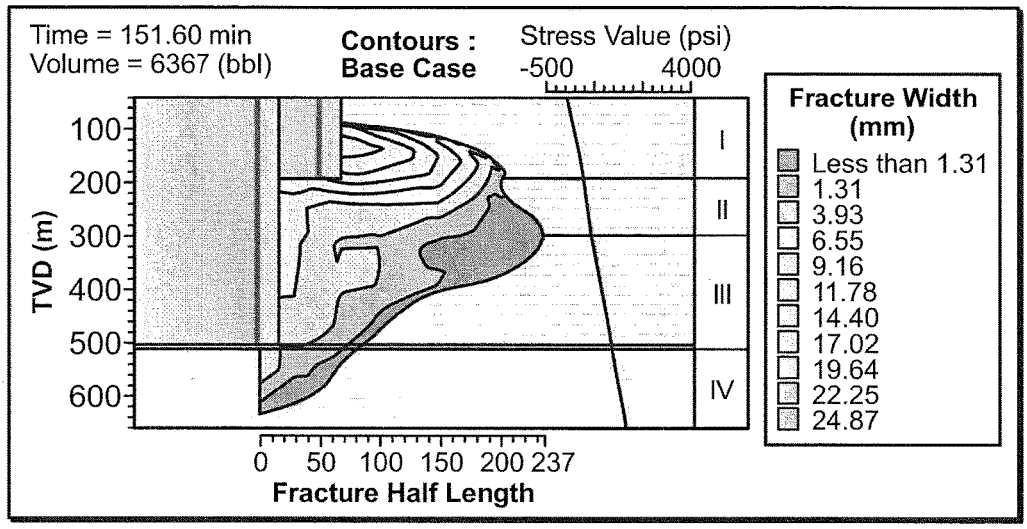
Figure 8C:
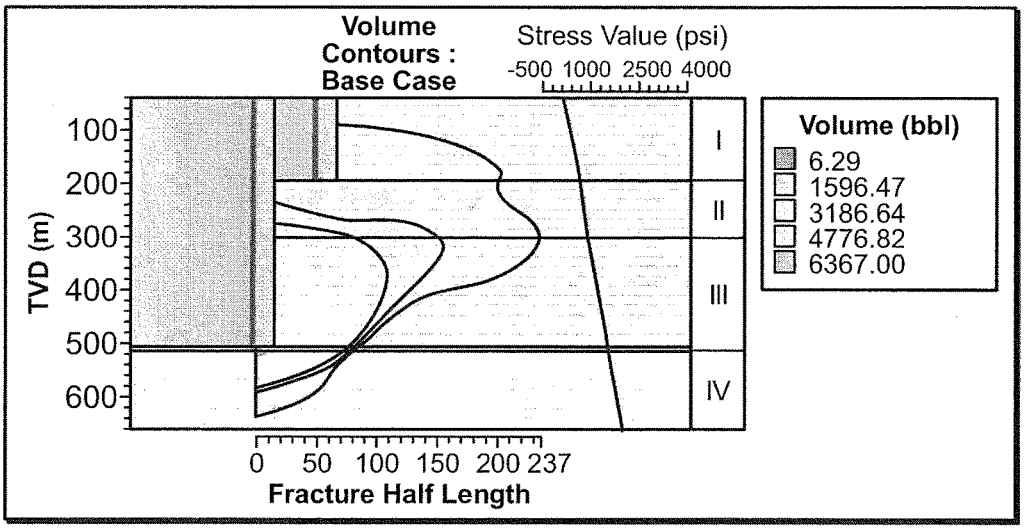

FIG. 8A summarizes the input geomechanical model used for the modeling and analysis of Case 1. Mud parameters were identical to that shown in FIG. 7B. Mud pumping rate was set to 42 bpm. The geomechanical model comprises layers 1-4. FIG. 8A summarizes, top and bottom locations of each layer, the formation type of each layer, the lithology of each layer, the pore pressure gradient of each layer, the pore pressure of each layer, the fracture gradient of each layer, the minimum horizontal stress of each layer, the Young's modulus of each layer, the fracture toughness of each layer, the Poisson's ratio of each layer, and the leakoff of each layer. As shown in FIG. 8A, the locations of the top and bottom of each layer are given in both TVDBRT and true vertical depth below mudline (TVDBML). FIG. 8B shows a fracture contour plot in accordance with one or more embodiments. For the parameters chosen in this simulation, fracture breach to surface/seabed occurs at a time of 151.60 minutes and a total mud volume of 6367 bbl. Maximum fracture dimensions were as follows: half length: 234.2 m, height growth upwards: 438.0 m, and height growth downwards: 123.2 m. Fracture contours at different injected volumes are shown in FIG. 8C.

Figure 9B:
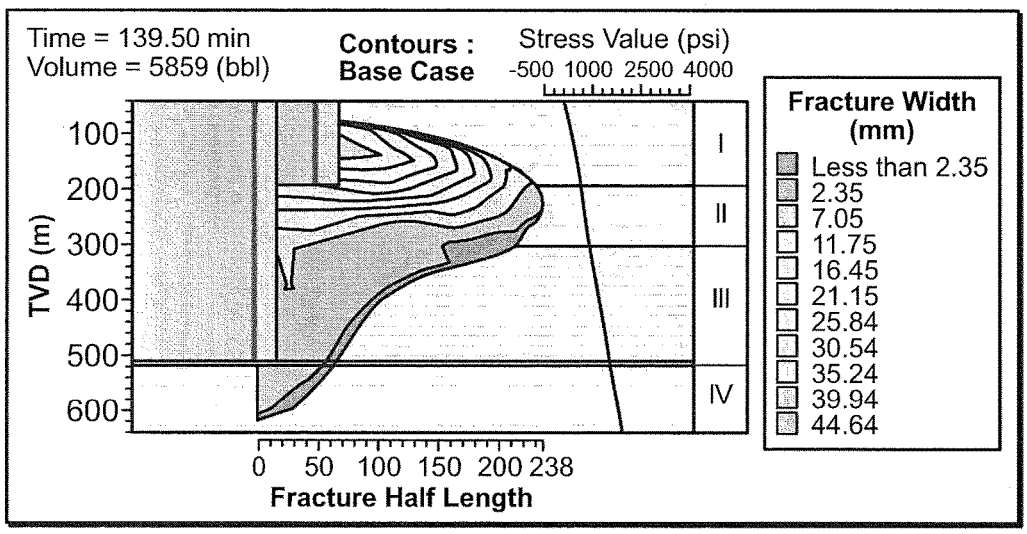
Figure 9C:
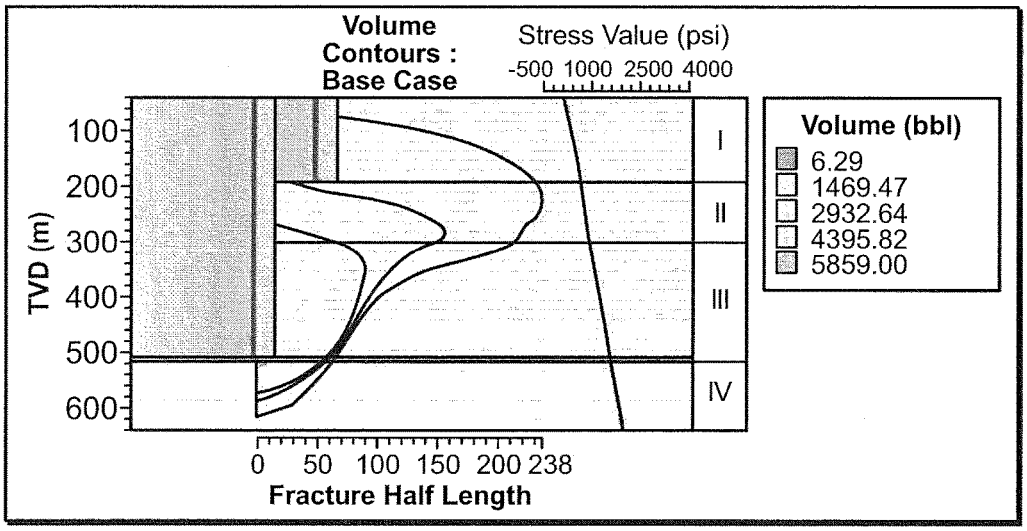

FIG. 9B summarizes the input geomechanical model used for the modeling and analysis of Case 2. Mud parameters were identical to that shown in FIG. 7B. Mud pumping rate was set to 42 bpm. The geomechanical model comprises layers 1-4. FIG. 9A summarizes, top and bottom locations of each layer, the formation type of each layer, the lithology of each layer, the pore pressure gradient of each layer, the pore pressure of each layer, the fracture gradient of each layer, the minimum horizontal stress of each layer, the Young's modulus of each layer, the fracture toughness of each layer, the Poisson's ratio of each layer, and the leakoff of each layer. As shown in FIG. 9A, the locations of the top and bottom of each layer are given in both TVDBRT and true vertical depth below mudline (TVDBML). FIG. 9B shows a fracture contour plot in accordance with one or more embodiments. For the parameters chosen in this simulation, fracture breach to surface/seabed occurs at a time of 139.5 minutes and a total mud volume of 5859 bbl. Maximum fracture dimensions were as follows: half length: 238.0 m; height growth upwards: 438.0 m; height growth downwards: 96.7 m. Fracture contours at different injected volumes are shown in FIG. 9C.

Figure 10B:
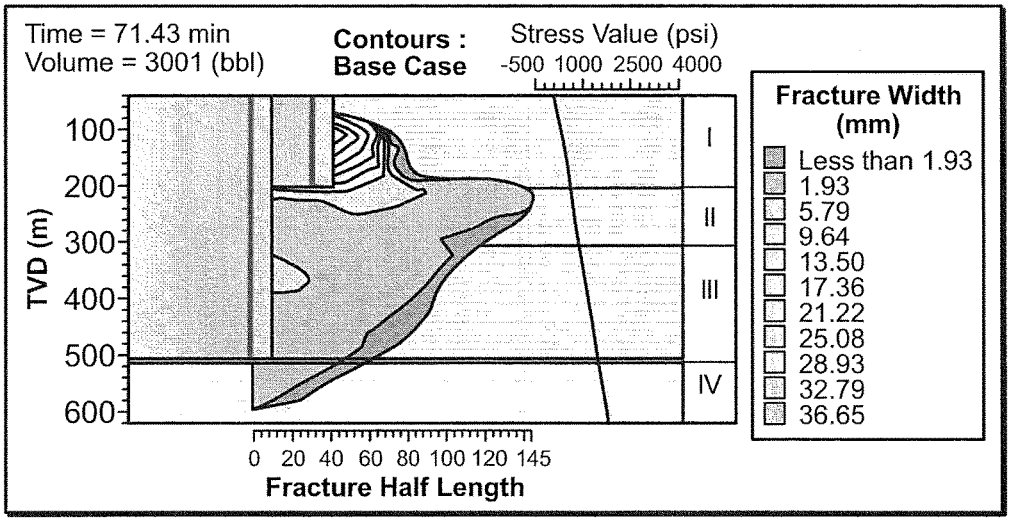
Figure 10C:
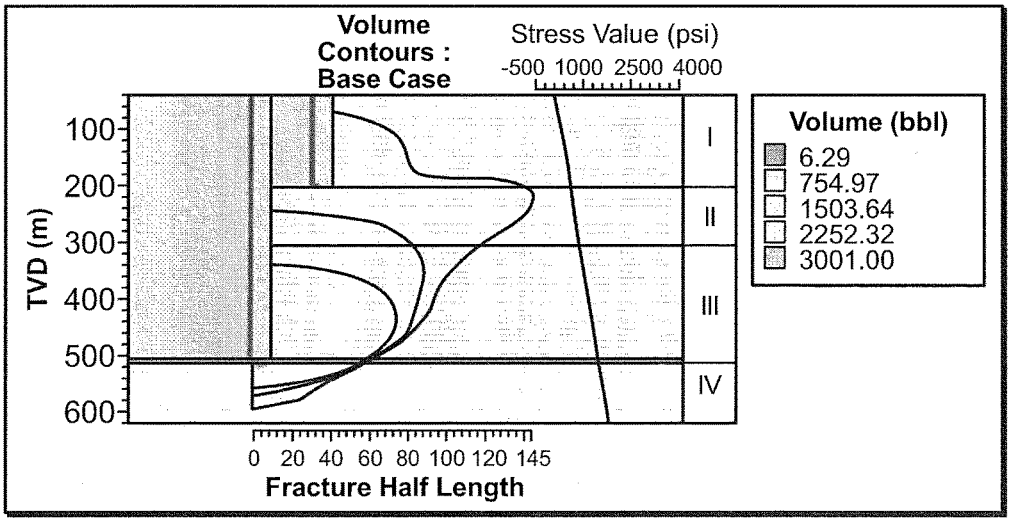

FIG. 10A summarizes the input geomechanical model used for the modeling and analysis of Case 3. Mud parameters were identical to that shown in FIG. 7B. Mud pumping rate was set to 42 bpm. The geomechanical model comprises layers 1-4. FIG. 10A summarizes, top and bottom locations of each layer, the formation type of each layer, the lithology of each layer, the pore pressure gradient of each layer, the pore pressure of each layer, the fracture gradient of each layer, the minimum horizontal stress of each layer, the Young's modulus of each layer, the fracture toughness of each layer, the Poisson's ratio of each layer, and the leakoff of each layer. As shown in FIG. 10A, the locations of the top and bottom of each layer are given in both TVDBRT and true vertical depth below mudline (TVDBML). FIG. 10B shows a fracture contour plot in accordance with one or more embodiments. For the parameters chosen in this simulation, fracture breach to surface/seabed occurs at a time of 71.43 minutes and a total mud volume of 3001 bbl. Maximum fracture dimensions were as follows: half length: 144.9 m, height growth upwards: 451.4 m, and height growth downwards: 90.0 m. Fracture contours at different injected volumes are shown in FIG. 10C.

Figure 11B:
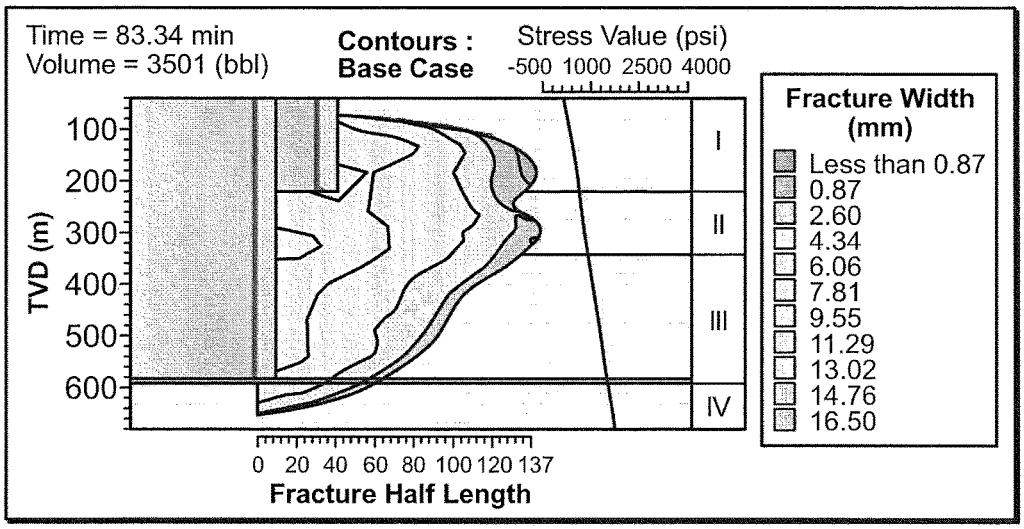
Figure 11C:
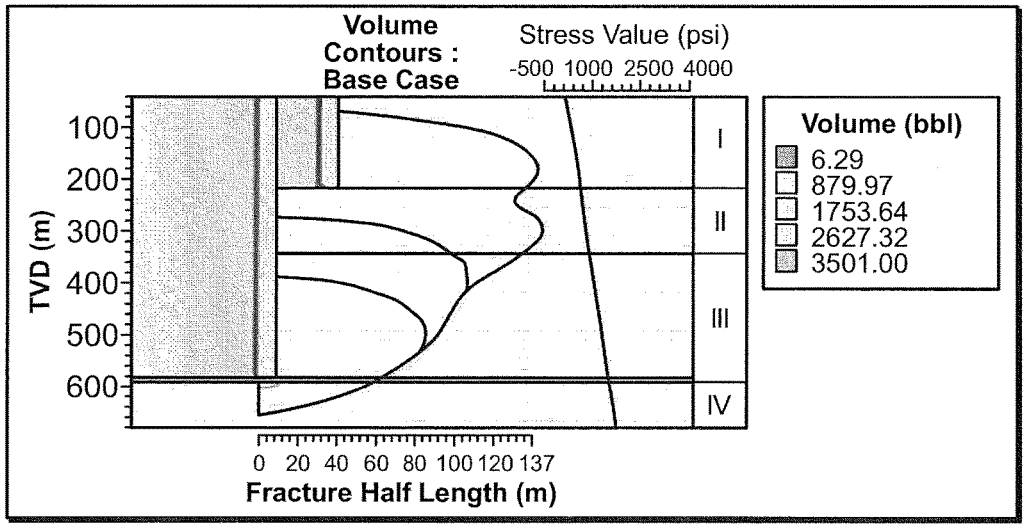

FIG. 11A summarizes the input geomechanical model used for the modeling and analysis of Case 4. Mud parameters were identical to that shown in FIG. 7B. Mud pumping rate was set to 42 bpm. The geomechanical model comprises layers 1-4. FIG. 11A summarizes, top and bottom locations of each layer, the formation type of each layer, the lithology of each layer, the pore pressure gradient of each layer, the pore pressure of each layer, the fracture gradient of each layer, the minimum horizontal stress of each layer, the Young's modulus of each layer, the fracture toughness of each layer, the Poisson's ratio of each layer, and the leakoff of each layer. As shown in FIG. 11A, the locations of the top and bottom of each layer are given in both TVDBRT and true vertical depth below mudline (TVDBML). FIG. 11B shows a fracture contour plot in accordance with one or more embodiments. For the parameters chosen in this simulation, fracture breach to surface/seabed occurs at a time of 83.34 minutes and a total mud volume of 3501 bbl. Maximum fracture dimensions were as follows: half length: 136.8 m, height growth upwards: 438.9 m, and height growth downwards: 55.0 m. Fracture contours at different injected volumes are shown in FIG. 11C.

Figure 12B:
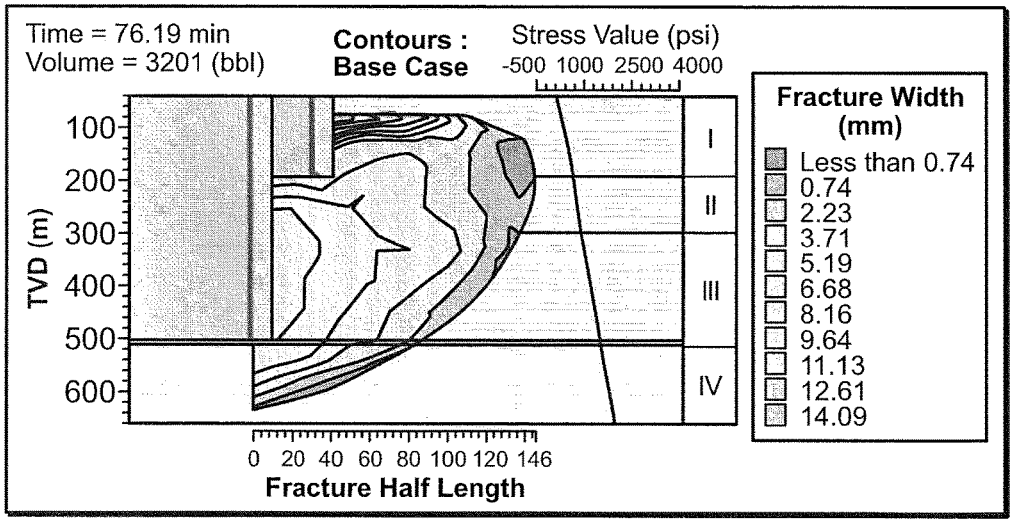
Figure 12C:
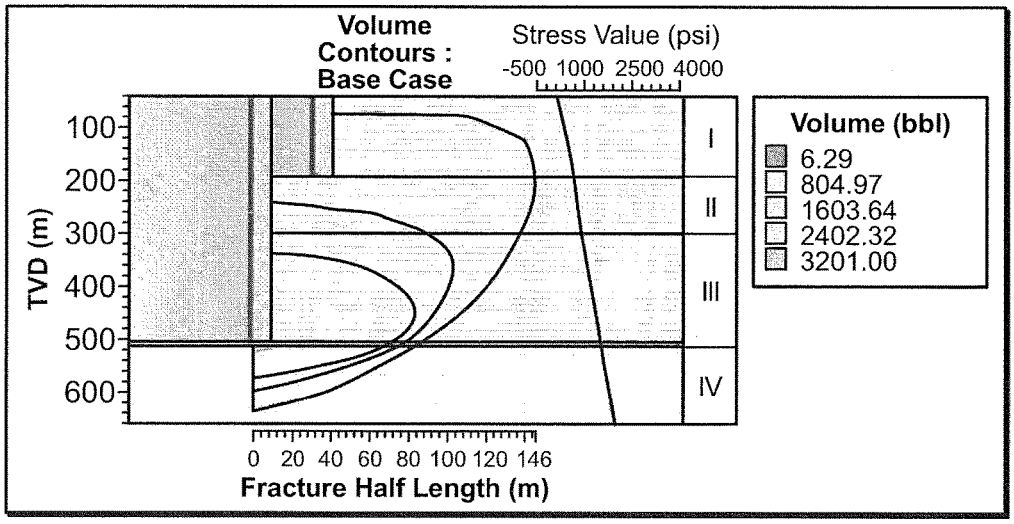

FIG. 12B summarizes the input geomechanical model used for the modeling and analysis of Case 5. Mud parameters were identical to that shown in FIG. 7B. Mud pumping rate was set to 42 bpm. The geomechanical model comprises layers 1-4. FIG. 12A summarizes, top and bottom locations of each layer, the formation type of each layer, the lithology of each layer, the pore pressure gradient of each layer, the pore pressure of each layer, the fracture gradient of each layer, the minimum horizontal stress of each layer, the Young's modulus of each layer, the fracture toughness of each layer, the Poisson's ratio of each layer, and the leakoff of each layer. As shown in FIG. 12A, the locations of the top and bottom of each layer are given in both TVDBRT and true vertical depth below mudline (TVDBML). FIG. 12B shows a fracture contour plot in accordance with one or more embodiments. For the parameters chosen in this simulation, fracture breach to surface/seabed occurs at a time of 76.19 minutes and a total mud volume of 3201 bbl. Maximum fracture dimensions were as follows: half length: 146.1 m, height growth upwards: 434.4 m, and height growth downwards: 123.9 m. Fracture contours at different injected volumes are shown in FIG. 12C.

Figure 13B:
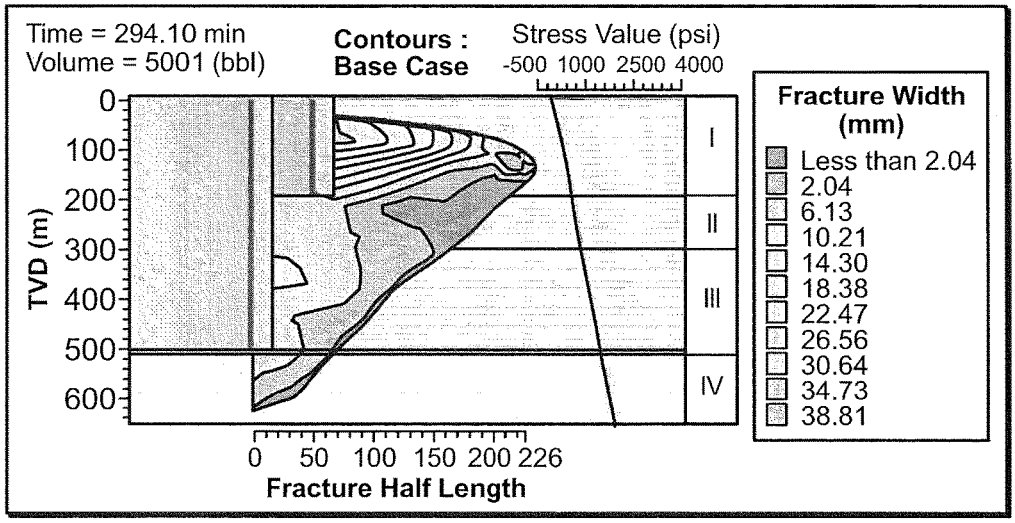
Figure 13C:
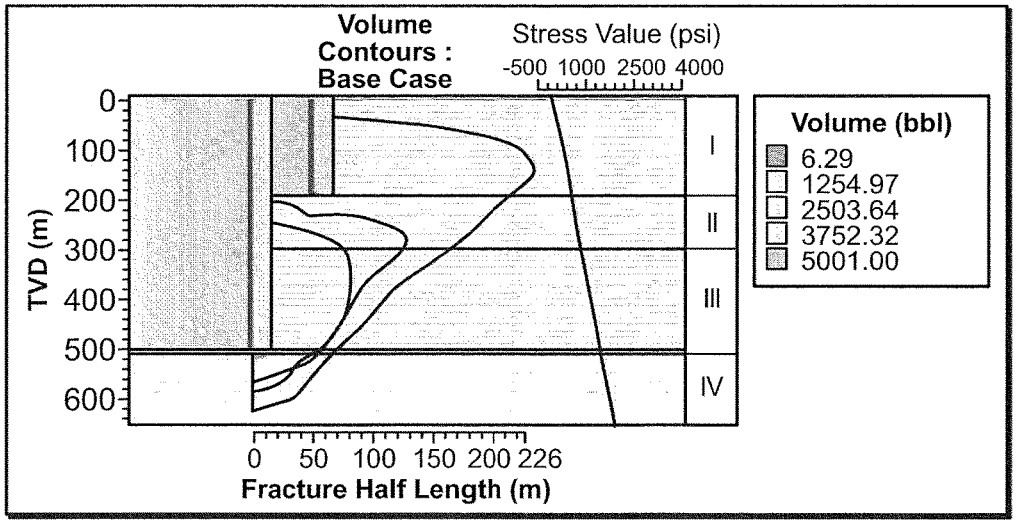

FIG. 13A summarizes the input geomechanical model used for the modeling and analysis of Case 3 using a 17 bpm pump rate. Mud parameters were identical to that shown in FIG. 7B. The geomechanical model comprises layers 1-4. FIG. 13A summarizes, top and bottom locations of each layer, the formation type of each layer, the lithology of each layer, the pore pressure gradient of each layer, the pore pressure of each layer, the fracture gradient of each layer, the minimum horizontal stress of each layer, the Young's modulus of each layer, the fracture toughness of each layer, the Poisson's ratio of each layer, and the leakoff of each layer. As shown in FIG. 13A, the locations of the top and bottom of each layer are given in both TVDBRT and true vertical depth below mudline (TVDBML). FIG. 13B shows a fracture contour plot in accordance with one or more embodiments. For the parameters chosen in this simulation, fracture breach to surface/seabed occurs at a time of 294.1 minutes and a total mud volume of 5001 bbl. Maximum fracture dimensions were as follows: half length: 225.8 m, height growth upwards: 482.5 m, and height growth downwards: 117.6 m. Fracture contours at different injected volumes are shown in FIG. 13C.

FIG. 14 shows a summary of the calculated injected fluid volume required for the fracture to breach to the surface or seabed for cases 1-6. FIG. 14 also shows the sub-surface data that was chosen and varied for each of the example cases 1-6. Case 6 was identical to case 3 in all respects except for the mud pump rate, which was set to 17 bpm. In accordance with one or more embodiments, the range of injected fluid volume which results in a fracture breach to seabed may be determined by examining the range of injected fluid volumes required for the fracture to breach the seabed produced by the simulation. Accordingly, for the well and formation simulated above, the range of volumes that result in a fracture breach to seabed is 3000 bbl to 6400 bbl. Accordingly, during a well control operation that injects mud into the well at 42 bpm, the simulation predicts that a fracture breach to seabed may occur for total injected volumes in the range of 3000 to 6400 bbl. Accordingly, the well may be controlled safely with a reduced risk that the hydraulic fracture will reach the surface or seabed by keeping the injected mud volume below the range of mud volumes predicted by the system for determining operational parameters for well control operations in accordance with one or more embodiments. In some embodiments, a safety factor may be applied to provide a max volume to be used for well control.

Figure 15:
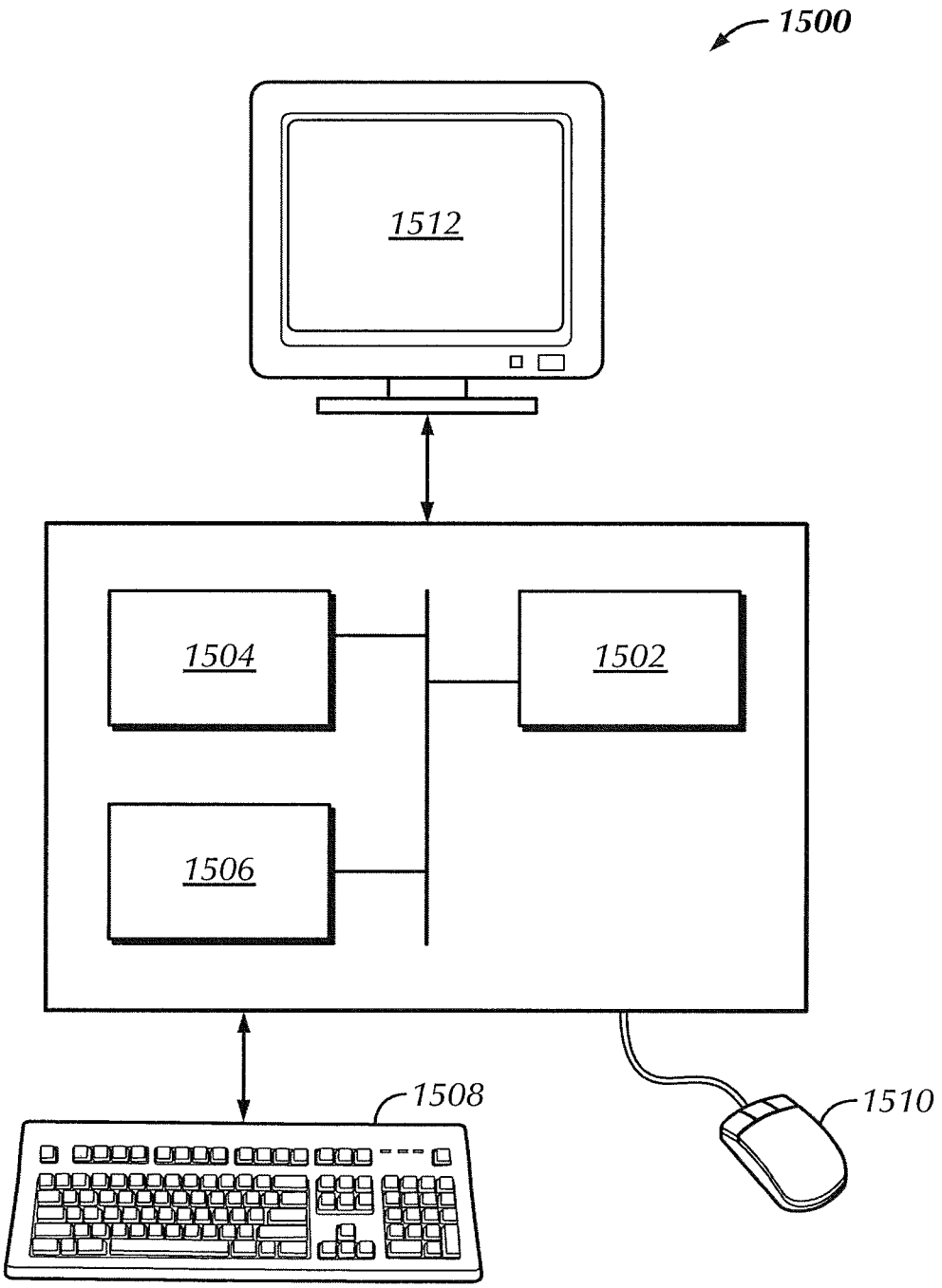
FIG. 15 shows a system for implementing modeling and analysis of hydraulic fracture propagation in accordance with one or more embodiments disclosed herein.

The method and system for modeling and analysis of hydraulic fracture propagation from a surface casing shoe may be implemented on virtually any type of computer regardless of the platform being used. For example, as shown in FIG. 15, a networked computer system (1500) includes a processor (1502), associated memory (1504), a storage device (1506), and numerous other elements and functionalities typical of today's computers. The networked computer (1500) may also include input means, such as a keyboard (1508) and a mouse (1510), and output means, such as a monitor (1512). The networked computer system (1500) is connected to a local area network (LAN) or a wide area network (e.g., the Internet) via a network interface connection (not shown). Those skilled in the art will appreciate that these input and output means may take other forms. Further, those skilled in the art will appreciate that one or more elements of the aforementioned computer (1500) may be located at a remote location and connected to the other elements over a network or satellite.

A computer readable medium may include software instructions which, when executed by a processor, perform a method that includes communicating with at least one oilfield element comprising sending commands and receiving sub-surface data of a formation, processing operational data related to a well control operation, generating a geomechanical model based on the received sub-surface data, simulating creation of a hydraulic fracture and propagation of the hydraulic fracture through the formation based on the operational data and the geomechanical model, and determining whether the hydraulic fracture reaches an upper surface of the formation. For example, a command may be sent to well control equipment to inject drilling fluid into an annulus of a well and/or to drilling equipment to adjust a drill string operation. The method may further include outputting an estimated volume of fluid pumped into a well when the hydraulic fracture is determined to reach an upper surface of the formation. The method may further include visually displaying the simulated hydraulic fracture. The method may also include processing new operational data when the hydraulic fracture does not reach the upper surface of the formation.

The well control operation may include at least one of a circulating fluid well control operation and a static well control operation. Processing operational data related to a well control operation may include defining a set of simulation parameters based on at least one of the well control type, fluid data, and the well casing data. Generating the geomechanical model may include determining formation characteristics based on the sub-surface data. Such formation characteristics may include one or more of in-situ stress data of the formation and minimum in-situ stress profiles of the formation. The height, width, and length of the hydraulic fracture may also be determined and the fracture propagation direction identified.

In accordance with one or more embodiments disclosed herein, the methods and apparatus for modeling and analysis of hydraulic fracture propagation from a surface casing shoe may provide hydraulic fracture containment assurance for well contingency planners who are planning a well kill operation before drilling commences within formations having overburden represented by weak and unconsolidated formations and where the risk of encountering shallow gas may be particularly high.

In accordance with one or more embodiments disclosed herein, the methods and apparatus for modeling and analysis of hydraulic fracture propagation from a surface casing shoe provide for a determination of a range of mud volumes that may be safely pumped into a well at a given rate before a hydraulic fracture reaches the surface or seabed. Thus, the methods and apparatus provide a method for hydraulic fracture containment assurance verification via numerical modeling of shallow hydraulic fracture propagation from a surface casing shoe.

In accordance with one or more embodiments disclosed herein, the methods and apparatus for modeling and analysis of hydraulic fracture propagation from a surface casing shoe provide a client with containment assurance on the volume range of mud that can be pumped safely into the well at a given rate when well kill is required. Implementation of modeling and analysis of hydraulic fracture propagation from a surface casing shoe in accordance with embodiments disclosed herein increases safety assurance of a well control operation (e.g., a static or circulating well kill operation) and adds an input into the shallow gas contingency planning process.

Although only a few example embodiments have been described in detail above, those skilled in the art will readily appreciate that many modifications are possible in the example embodiments without materially departing from the scope of embodiments disclosed. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method comprising:

obtaining sub-surface data related to a formation surrounding a well;

building a geomechanical model of the formation based on the sub-surface data;

obtaining operational data related to a well control operation;

performing, on a processor, a hydraulic fracture simulation of the formation, wherein the hydraulic fracture simulation is based on the obtained operational data and the built geomechanical mode and calculates an estimated range of fluid volumes that results in a fracture breach to a surface or a seabed of the formation;

determining a control volume of fluid to be pumped into the well, by using or applying a safety factor in conjunction with the estimated range of fluid volumes, calculated by the hydraulic fracture simulation, that results in a fracture breach to the surface or the seabed of the formation, wherein the control volume is determined by multiplying or dividing a volume within the estimated range of fluid volumes by the safety factor; and controlling the well with a reduced risk that a hydraulic fracture reaching the surface or the seabed by pumping the control volume of fluid into the well, wherein the control volume of fluid pumped into the well is below the estimated range of fluid volumes calculated by the hydraulic fracture simulator.

2. The method of claim 1, wherein the sub-surface data comprises:

lithostratigraphic data;

geological test data; and regional geomechanical data.

3. The method of claim 1, wherein the operational data comprises:

a type of well control operation;

fluid data relating to properties of a fluid used for the control operation;

expected range of fluid pumping rate; and well casing data relating to a casing of the well to be controlled.

4. The method of claim 3, wherein the type of well control operation is one selected from a group consisting of a circulating fluid well control operation and a static well control operation.

5. The method of claim 3, wherein obtaining the operational data further comprises defining a set of simulation parameters based on at least one of the type of well control operation, the fluid data, and the well casing data.

6. The method of claim 1, wherein building the geomechanical model further comprises:

computing formation characteristics based on the sub-surface data.

7. The method of claim 6, wherein the formation characteristics include at least one selected from a group consisting of an in-situ stress dataset of the formation and a minimum in-situ stress profile of the formation.

8. The method of claim 1, further comprising identifying a fracture propagation direction.

9. The method of claim 1, further comprising initiating the simulation based on the sub-surface data.

10. The method of claim 1, wherein the determining of the control volume comprises either multiplying the volume within the estimated range of fluid volumes by the safety factor that is less than 1 or dividing the volume within the estimated range of fluid volumes by the safety factor associated that is greater than 1 such that the determined control volume is below the estimated range of fluid volumes calculated by the hydraulic fracture simulator.

11. A system comprising:

a processor;

a memory;

a geomechanical model generating module configured to generate a geomechanical model of a sub-surface formation surrounding a well;

an operational data generating module configured to generate operational data relating to a well control type and comprising at least one input parameter for a hydraulic fracturing simulation executing on the processor;

a simulating module configured to perform the hydraulic fracturing simulation based upon the geomechanical model and the operational data, wherein the simulating module is configured to determine a control volume of fluid that is injectable into the well, by using a safety factor in conjunction with an estimated range of fluid volumes, calculated by the hydraulic fracturing simulation, that results in a fracture breach a surface or a seabed of the sub-surface formation, wherein the control volume is determined by multiplying or dividing a volume within the estimated range of fluid volumes by the safety factor; and a drilling subsystem configured to conduct a well control operation by injecting the control volume of fluid into the well, wherein the control volume of fluid injectable into the well is below the estimated range of fluid volumes calculated by the hydraulic fracturing simulation performable by the simulating module.

12. The system of claim 11, further comprising a surface module configured to perform a well control operation based on the estimated range of fluid volumes calculatable by the hydraulic fracturing simulation.

13. The system of claim 12, wherein the surface module is configured to receive sub-surface data from oilfield elements.

14. The system of claim 11, further comprising a data repository linked to at least one of the geomechanical model generating module, operational data generating module, and the simulating module and configured to receive, store, and send at least one of the operational data and sub-surface data.

15. A computer readable, non-transitory storage medium comprising software instructions which, when executed by a processor, perform a method comprising:

communicating with at least one oilfield element comprising sending commands and receiving sub-surface data of a formation;

processing operational data related to a well control operation;

generating a geomechanical model based on the received sub-surface data;

simulating creation of a hydraulic fracture and propagation of the hydraulic fracture through the formation based on the operational data and the geomechanical model and calculating an estimated range of fluid volumes that results in the hydraulic fracture and propagation of the hydraulic fracture through the formation;

determining a control volume of fluid that is injectable into a well, by using a safety factor in conjunction with the estimated range of fluid volumes that results in the hydraulic fracture to breach a surface or a seabed of the formation, wherein the control volume is determined by multiplying or dividing a volume within the estimated range of fluid volumes by the safety factor; and conducting the well control operation by pumping the control volume of fluid into the well, wherein the control volume of fluid is below the estimated range of fluid volumes that results in the hydraulic fracture and propagation of the hydraulic fracture through the formation.

16. The computer readable, non-transitory storage medium of claim 15, wherein the sending commands comprises sending a command to well control equipment to inject drilling fluid into an annulus of a well.

17. The computer readable, non-transitory storage medium of claim 15, wherein the sending commands comprises sending a command to drilling equipment to adjust a drill string operation.

18. The computer readable, non-transitory storage medium comprising software instructions of claim 15 which, when executed by the processor, perform the method further comprising outputting an estimated volume of fluid pumped into a well when the hydraulic fracture is determined to reach the surface or the seabed of the formation.

19. The computer readable, non-transitory storage medium comprising software instructions of claim 15 which, when executed by the processor, perform the method further comprising visually displaying the simulated hydraulic fracture.

20. The computer readable, non-transitory storage medium comprising software instructions of claim 15 which, when executed by the processor, perform the method further comprising processing new operational data when the hydraulic fracture does not reach the surface or the seabed of the formation.

* * * * *